United States Patent [19]

Tetenborg

[11] Patent Number: 5,005,341

[45] Date of Patent: Apr. 9, 1991

[54] APPARATUS FOR FILLING SACKS

[75] Inventor: Konrad Tetenborg, Lengerich, Fed. Rep. of Germany

[73] Assignee: Windmoller & Holscher, Lengerich, Fed. Rep. of Germany

[21] Appl. No.: 411,381

[22] Filed: Sep. 25, 1989

[30] Foreign Application Priority Data

Sep. 26, 1988 [DE] Fed. Rep. of Germany ..... 3832634

[51] Int. Cl.[5] ..... B65B 39/02; B65B 43/30

[52] U.S. Cl. ..... 53/570; 53/261; 53/386; 141/114; 141/166; 141/314

[58] Field of Search ..... 53/260, 261, 268, 292, 53/386, 459, 570, 571, 572, 573; 141/114, 166, 314, 315, 316

[56] References Cited

U.S. PATENT DOCUMENTS

| | | | |
|---|---|---|---|
| 2,703,671 | 3/1955 | Kindseth | 141/114 X |
| 2,790,540 | 4/1957 | Gaubert | 141/166 |
| 3,501,893 | 3/1970 | Peterson | 53/386 |
| 3,830,266 | 8/1974 | Hudson | 141/10 |
| 3,851,444 | 12/1974 | Merat | 53/570 X |
| 4,174,599 | 11/1979 | Callet et al. | 53/386 X |
| 4,537,013 | 8/1985 | Tetenborg et al. | 53/570 |
| 4,563,864 | 1/1986 | Eschmann | 53/570 |
| 4,579,154 | 4/1986 | Müller | 141/114 X |
| 4,586,320 | 5/1986 | Takai et al. | 53/571 X |

FOREIGN PATENT DOCUMENTS 3140332 4/1983 Fed. Rep. of Germany .

*Primary Examiner*—Robert L. Spruill
*Assistant Examiner*—Linda B. Johnson
*Attorney, Agent, or Firm*—Fleit, Jacobson, Cohn, Price, Holman & Stern

[57] ABSTRACT

An apparatus for filling sacks is disclosed which has opposed clamps for engaging the initially collapsed sacks adjacent to the side portions of their opening-defining edges, suction devices included in the clamps, which engage mutually opposite side walls of the sacks adjacent to their opening-defining edges and pull said side walls apart, and a filling pipe. The carriers for the suction devices are provided each on each side of the sack at least below the suction device or suction devices with a transversely extending bar, which is made of elastomeric material and urges the pulled apart edge portions of the sacks into sealing contact with the side walls of the filling funnel.

2 Claims, 3 Drawing Sheets

APPARATUS FOR FILLING SACKS

BACKGROUND OF THE INVENTION

1. Field of the Invention

This invention relates to apparatus for filling sacks comprising clamping means for engaging the initially collapsed sacks adjacent to the side portions of their opening-defining edges, suction devices, which engage mutually opposite side walls of the sacks adjacent to their opening-defining edges and pull said side walls apart, and a filling pipe.

2. Description of the Prior Art

In the operation of such apparatuses, which are known e.g., from U.S. Pat. No. 4,537,013 (corresponding to Published European Patent Application 82 955), U.S. Pat. No. 3,830,266 and British Patent Specification No.691,916, it has been observed that dustlike content of the sack will adhere to the inside surfaces of the sack walls which are made of thermoplastic material, specifically in those regions in which the suction devices engages the side walls on the outside. This is due to the fact that when the suction devices pull the sack walls apart the suction devices move relative to said sack walls so that electrostatic charges are produced on the sack walls consisting of thermoplastic material and said charges subsequently attract dustlike contents of the sack. Because the sealing seam welds are usually formed specifically in the regions in which the suction devices have previously been applied to pull open the sacks for the insertion of the filling pipe, the adherent dustlike contents of the sack may adversely affect the quality or tightness of the sealing seam welds.

SUMMARY OF THE INVENTION

For this reason it is an object of the invention to provide an apparatus which is of the kind described first hereinbefore and in which an adhesion of dustlike contents of the sack on the sack walls in the regions engaged by the suction devices will be avoided.

In an apparatus of the kind described first hereinbefore that object is accomplished in that the carriers for the suction devices are provided each on each side of the sack at least below the suction device or suction devices with a transversely extending bar, which is made of elastomeric material and urges pulled apart edge portions of the sacks into sealing contact with the side walls of the filling funnel. In the apparatus in accordance with the invention, the suction device carriers have a dual function: They carry and move the suction devices and they carry transversely extending sealing bars. When the edges of the sacks have been pulled apart by the suction devices, the carriers for the suction devices are so controlled and moved by the associated drives that the sealing bars are urged against the walls of the filling pipe when the latter has been introduced into the sack. As a result, the sealing bars will protect the inside surfaces of the sack walls from rising dustlike contents of the sack in those regions in which the suction devices are applied or had been applied so that such contents cannot be deposit on the sack walls in regions which have been electrostatically charged by the pulling-open operation.

In accordance with a further feature within the scope of the invention the sealing bars are wider than the suction devices and the suction devices are accommodated in a recess of the bars. In that case the sealing bar entirely embraces the suction devices so that those portions of the sack walls in which the suction devices are or had been applied can be urged into sealing contact with the walls of the filling funnel and as a result will be protected against an access of rising dustlike contents of the sack even if the sealing bars do not effect a complete seal at the filling opening of the sack by a cooperation with the remaining parts of the filling funnel.

In accordance with a further feature within the scope of the invention a filling pipe is used which is, e.g., of the kind that has been disclosed in U.S. Pat. No. 4,537,013 and comprises filling funnel halves which are pivotally movable on mutually opposite senses about parallel axes which are transverse to the line that connects the clamping means, wherein each half of the filling funnel is U-shaped in cross-section, the filling funnel halves have side walls which are constituted by the legs of the U-shaped cross-section and are parallel to the plane in which the filling funnel halves are pivotally movable, said side walls overlap each other when said filling funnel halves have pivotally moved apart as far as possible, and the sealing bars are formed with steps adjacent to the edges of the overlapping side walls of the filling funnel halves and said steps are so arranged and designed that the sealing bars are adapted to urge the pulled apart edge portions of the sacks into sealing contact with the mutually overlapping side walls of the halves of the filling funnel. In the apparatus disclosed in U.S. Pat. No. 4,537,013 the filling funnel can be moved into sealing contact of the opening-defining edge of the sacks which are to be filled because the halves of the filling funnel can be pivotally movable outwardly. But in that case there may still be a gap between the overlapping edge portions of the side walls of the halves of the filling funnel and dustlike contents of the sack may escape through said gap and may deposit on those regions of the sack walls which have been statically charged by the movements of the suction devices. Even if the sealing bars do not have a sufficient elasticity and compliance to bridge the steps which are formed by the overlapping edge portions of the side walls of the halves of the filling funnel, an improved seal will be effected by the sealing bars at the steps.

In that design too, the suction devices are provided above the sealing bars on the carrier which is provided with the sealing bars or the suction devices are accommodated in recesses of the sealing bars.

DETAILED DESCRIPTION OF THE PREFERRED EMBODIMENT

Figure 1:
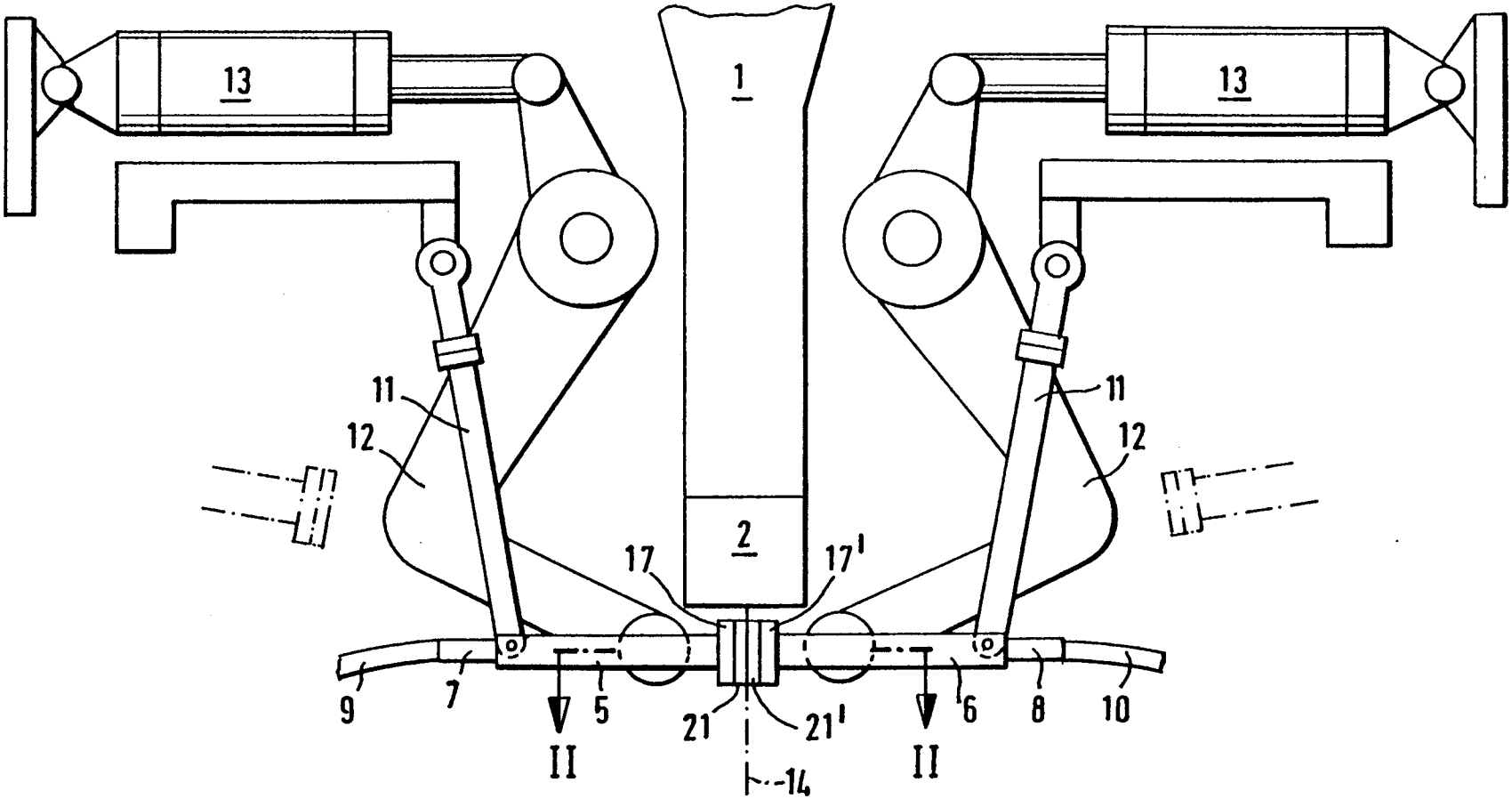
FIG. 1 is a diagrammatic side elevation showing a device for pulling apart the opening-defining edges of a sack, which device is provided with suction devices.

The filling pipe 1 shown in FIG. 1 is provided with a filling funnel 2, which consists of two halves 3, 4, which are movable relative to each other and which may movably be mounted and designed as disclosed in U.S. Pat. No. 4,537,013.

Figure 2:
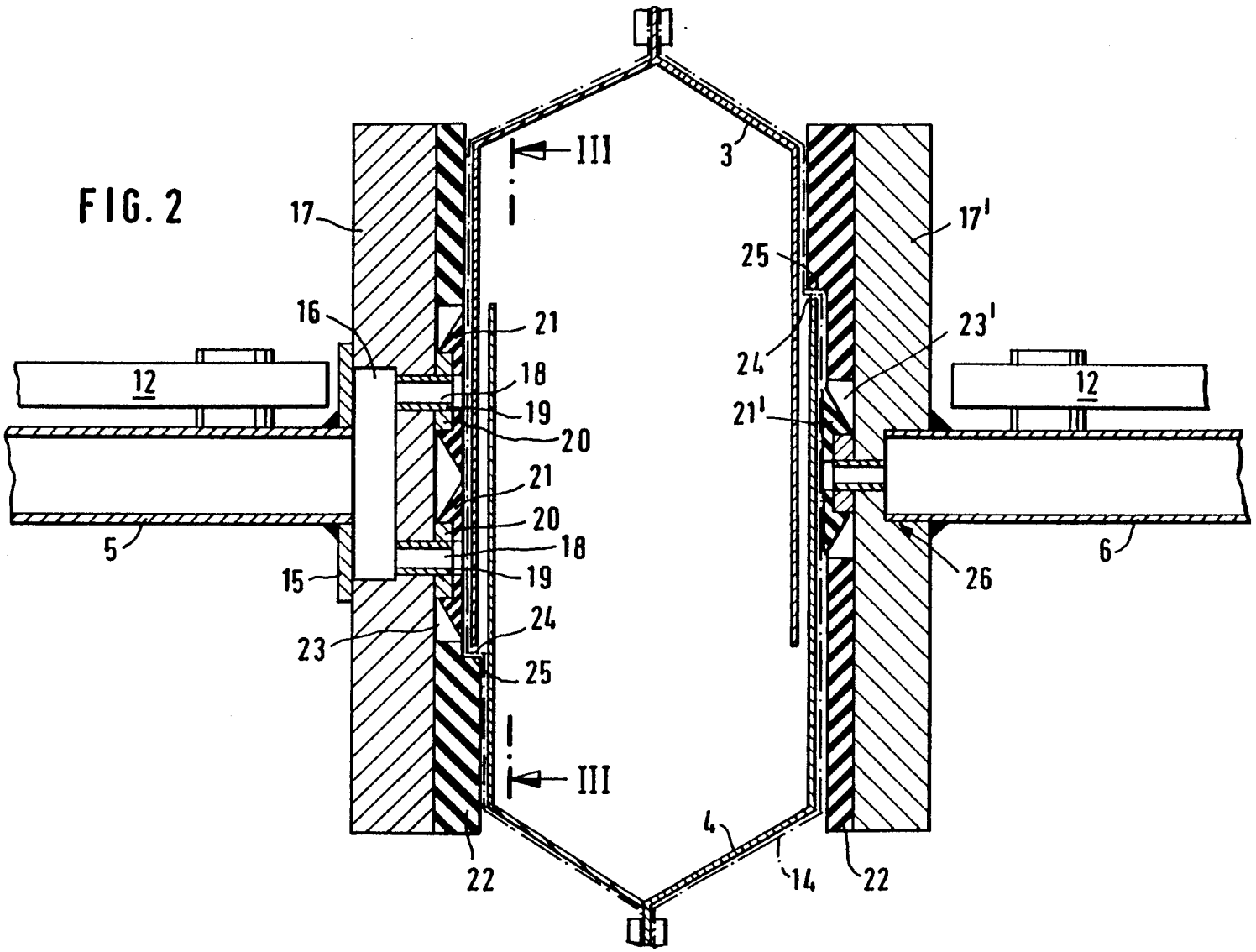
FIG. 2 is a sectional view taken on line II—II FIG. 1, and showing the device
Figure 3:
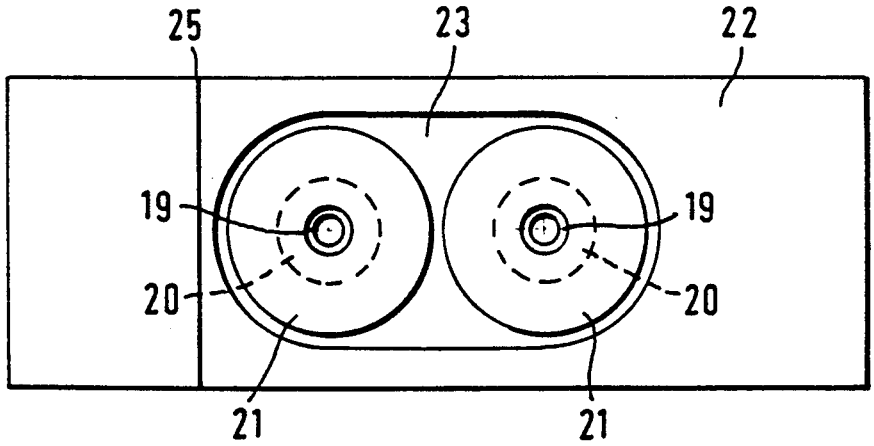
FIG. 3 is a sectional view taken in the direction of the arrow III in FIG. 2 on the sealing bar when the sack and the halves of the filling funnel have been removed.

The design of the suction devices is shown in FIG. 2, from which it is apparent that a tube 5 is welded to a flange 15, which has a bore which corresponds to the outside diameter of the tube 5. That flange 15 closes a recess 16, which is formed in a steel plate 17. Two bores 18 extend through the bottom of the recess 16 and into pipes 19, which protrude from the plate 17 on the side thereof which is opposite to the tube 5. Carrying rings 20 are mounted on the protruding ends of the pipes 19 and each of them carries a shallow bowl-shaped suction cup 21 made of rubber. A rubber bar 22 has been adhesively fixed to the plate 17. The rubber bar 22 has an oval aperture 23 having the same external dimensions as the plate 17 so that the suction cups of rubber 21 are entirely surrounded by the rubber bar. Because the two halves 3 and 4 of the filling funnel 3 and 4 laterally overlap each other when the funnel is open, they form a step 24. An escape of material from the sack in that region is prevented in that the rubber bar 22 is formed with a step 25, which is complementary to the step 24 so that the rubber bar 22 can urge the sack 14 into sealing contact with the fulling funnel 3, 4 at the step 24.

The right-hand side of the suction device shown in FIG. 2 differs from the left-hand one only in that a single shallow bowl-shaped suction cup 21' made of rubber is provided rather than two of such suction bowls. In that case the plate 17' is not formed with a recess 16 but with a bore 26, into which a pipe 6 has been inserted. It will be understood that the aperture 23' is circular because only one suction cup 21' of rubber is used.

I claim:

1. Apparatus for filling sacks which includes opposed clamping assemblies for engaging opposite side walls of a sack adjacent an opening-defining edge of the sack and for pulling said side walls apart to open the sack for filling, and a pipe for filling the sack when opened, wherein each clamping assembly includes a suction device for engaging the respective side wall of the sack and a carrier for the suction device which includes a strip of elastomeric material at least partially surrounding the respective suction device for urging the side edges of the sack into sealing contact with side walls of the pipe, and recesses formed in the strips of elastomeric material, said suction devices accommodated in said recesses.

2. Apparatus as claimed in claim 1 wherein the pipe is formed by opposed U-shaped members with overlapping portions defining steps therebetween on opposite sides of the pipe and wherein the strips of elastomeric material of the respective carriers are formed with shoulders to accommodate said steps.

* * * * *